US006339848B1

(12) United States Patent
Mayhood et al.

(10) Patent No.: US 6,339,848 B1
(45) Date of Patent: Jan. 22, 2002

(54) BELT SLEEVE SYSTEM AND METHOD

(76) Inventors: Malinda L. Mayhood, 2937 Wood Crest Dr., Sarasota, FL (US) 34239; Whitney C. Huffman, 5102 - 19th Ct., E., Bradenton, FL (US) 34203

( * ) Notice: Subject to any disclaimer, the term of this patent is extended or adjusted under 35 U.S.C. 154(b) by 0 days.

(21) Appl. No.: 09/574,958

(22) Filed: May 19, 2000

(51) Int. Cl.[7] ..... A41F 9/00
(52) U.S. Cl. ..... 2/338
(58) Field of Search ..... 2/338, 310, 107, 2/112, 117, 311–322, 329, 235, 300, 301, 340; 24/163 R, 182, 265 BC; 63/3, 21

(56) References Cited

U.S. PATENT DOCUMENTS

| | | | | | |
|---|---|---|---|---|---|
| 2,070,016 | A | * | 2/1937 | Lipton | 241/1 |
| 2,087,620 | A | | 7/1937 | Lipton | |
| 2,885,684 | A | | 5/1959 | Dye et al. | |
| 3,636,569 | A | * | 1/1972 | Nielson | 2/325 |
| 4,753,086 | A | | 6/1988 | Schmidt | |
| 5,313,669 | A | * | 5/1994 | Rasdell et al. | 2/323 |
| 5,826,280 | A | * | 10/1998 | Bradley | 2/322 |
| 5,852,829 | A | * | 12/1998 | Relaford | 2/338 |

* cited by examiner

*Primary Examiner*—John J. Calvert
*Assistant Examiner*—Tejash Patel
(74) *Attorney, Agent, or Firm*—Dorothy S. Morse

(57) ABSTRACT

A readily installed and rapidly detachable flexible sleeve system for belts, as well as a method for its manufacture, into which a belt having a buckle with a tongue can be inserted and secured by the tongue to cover the entire front surface of the belt with a variety of materials having different colors, textures, and designs, and thereby make it more versatile as a fashion accessory. The present invention comprises a reinforced aperture near to its anchored end, cooperating parts of a two-part quick-release fastener positioned on opposite sides of the aperture, a transverse opening for belt insertion, and at least one aperture through the distal end of the sleeve. Optionally, one of the fastener parts can be attached to the rear surface of the belt, instead of the sleeve. Each sleeve is further configured so that when it is in its usable position upon a belt, it will not interfere with the routine fastening and use of the belt during its garment support function. Applications of the present invention can include, but are not limited to, decorating a single belt on successive occasions with different materials relating to the same or different holiday celebrations, use at sporting events to show support of a specific school or professional sports team, and to alternatively change the look of a single belt from a casual appearance to one that is suitable for more formal occasions so as to make the belt more versatile as a fashion accessory.

20 Claims, 4 Drawing Sheets

BELT SLEEVE SYSTEM AND METHOD

BACKGROUND—Field of Invention

This invention relates to belts used as clothing accessories, specifically to a readily installed and rapidly detachable flexible sleeve system for belts, as well as a method for its manufacture, into which a belt having a buckle with a tongue can be at least partially inserted and secured by the tongue to cover the entire front surface of the belt with a variety of materials having different colors, textures, and designs, and thereby make each belt used with the system more versatile as a fashion accessory. Each sleeve of the present invention has a reinforced aperture near to one of its ends for anchoring a belt buckle's tongue, and a two-part quick-release fastener with each fastener part located at an independent spaced-apart distance on opposite sides of the reinforced aperture, a first fastener part being located on the back surface of the sleeve close to the end of the sleeve adjacent to the reinforced aperture, and the second fastener part either being attached to the rear surface of the belt or to the back surface of the sleeve. Each sleeve also has a transverse opening through which the non-buckle end of the belt is secured and at least one aperture in the distal end of the sleeve adapted for facilitating alignment of the tongue with the holes in the non-buckle end of the belt. Each sleeve of the present invention is further configured so that when it is in its usable position upon a belt, it will not interfere with the routine fastening and use of the belt during its garment support function. Applications of the present invention can include, but are not limited to, decorating a single belt on successive occasions with different materials relating to the same or different holiday celebrations, use at sporting events to show support of a specific school or professional sports team, and to alternatively change the look of a single belt from a casual appearance to one that is suitable for more formal occasions so as to make the belt more versatile as a fashion accessory.

BACKGROUND—Description of Prior Art

Although primarily serving a functional purpose, belts worn with apparel are also used to accessorize a garment and make a fashion statement. Many people own a variety of belts to have a diversity of color, material, and design for casual as well as more formal occasions. Additional belts are often purchased to accessorize a specific outfit, and for special occasion use, such as belts with color combinations, designs, or attached hardware relating to a favorite sport, sports team, hobby, pet, or special interest. Although belts range widely in price according to the quality of the materials from which they are made and their design, the cost of creatively accessorizing a business or social wardrobe with a diverse selection of belts would be significant. Also, since belts can be bulky and their buckles sometimes make them difficult to store, a disadvantage to owning a large number of belts is the storage space needed to contain those not in use. The present invention offers a convenient, low in cost, and rapid means of changing the outer appearance of a belt so that a single belt could be used to accessorize an entire wardrobe. The belt sleeves of the present invention are also easy-to-use and more compactly stored than an identical number of belts, and since they can be produced in a nearly infinite variety of colors, textures, and patterns, they can cover a favorite belt to make its use suitable for every day as well as special occasion use.

The prior art believed to be most closely related to the present invention are the inventions disclosed in U.S. Pat No. 4,753,086 to Schmidt (1988), U.S. Pat. No. 2,087,620 to Lipton (1937), and U.S. Pat. No. 2,885,684 to Dye (1959). The Schmidt invention discloses a costume jewelry circlet having a variety of interchangeable tubular sleeves positioned over a string-like core that can be used as a bracelet, necklace, or belt. The Schmidt sleeve can be removed from the core by disengaging the ends of the core and simply pulling the sleeve off of the core. Both of the ends of the core in the Schmidt invention remain outside of its sleeve. In contrast, the non-buckle end of an underlying belt is positioned within the sleeve of the present invention during use. Also, the present invention has a transverse opening on the hidden surface of the sleeve and one or more openings through both the hidden and exposed surfaces of the sleeve on its distal end. Further, to maintain an optimum position relative to the underlying belt, the present invention is secured with a two-part quick-release fastener either to itself near the buckle or to the rear surface of the portion of the belt not covered by the sleeve. In contrast, the Schmidt invention discloses no fastener for securing its sleeve to its core. The present invention is also distinguishable from the Lipton invention which discloses a garter composed of elastic surrounded by a fabric sheath. The sheath of the Lipton invention has a cover flap for concealing an adjusting slide while also giving easy access to the slide when so needed for varying the length of the garter for the comfort of the wearer. Also, while the sheath of the Lipton invention does contain a transversely positioned buttonhole, it does not contain longitudinally positioned openings on the opposite end of the sheath. The present invention is also distinguishable from the Dye invention which discloses sheathes each configured for covering a belt to change the surface appearance thereof. Each Dye sleeve preferably has cross-stitching on each seam edge to eliminate bulging material and to facilitate turning the sheath inside out. The Dye sheath is also connected to a belt buckle via a clamping device rather than depending from its tongue. Further, the sheath of the Dye invention has no transverse opening, nor does the Dye invention have any longitudinal positioned openings on the opposite end of the sheath. It is not known to have a sleeve for changing the surface appearance of a belt with a tongue having the construction of the sleeve disclosed in the present invention, nor one with all of its advantages.

SUMMARY OF INVENTION—Objects and Advantages

The primary object of this invention is to provide simple, easy-to-use, rapidly installed and removed sleeves in a variety of colors, textures, and designs that can be used to vary the outward appearance of a belt with a tongue so that it is possible for a single belt to be decorated and used for a multitude of festive occasions, at various sporting events to show support of a specific school or professional sports team, and at events requiring either casual or formal attire. A further object of this invention is to provide belt sleeves from a widely diverse selection of materials and at a cost that is generally lower than belt replacement. It is a further object of this invention to provide belt sleeves in materials not routinely used to make the main body of a belt so as to offer more diverse fashion choices beyond those currently available to the public. It is also an object of this invention to provide belt sleeves that do not require the handling of small, easily lost parts, or special tools. A further object of this invention is to provide belt sleeves that can be retrofitted for use with existing belts as well as constructed for use with a belt having a fastener attached thereto for specific use with such sleeves. It is also an object of this invention to provide belt sleeves having a configuration that does not interfere with the garment support function of the underlying belt.

As described herein, properly manufactured and used, the present invention would provide sleeves that could be used with a favorite belt having a tongue to change its appearance to suit a variety of special occasions. In the alternative, a belt designed and manufactured for specific use with such sleeves could be used. The sleeves would be made from a variety of flexible materials, with opposite sides of the sleeve being made from the same or different materials. Having the hidden surface of the sleeve, or a part of the hidden surface, made from a second type of material could provide an advantage when the exposed surface of the sleeve is made from very bulky or expensive material. The sleeves are simple in construction having a reinforced aperture near to its buckle end to anchor the sleeve to the tongue of a belt buckle, as well as one part of a two-part quick-release fastener attached to the sleeve between the reinforced aperture and its buckle end. The second part of the two-part quick-release fastener may alternatively be attached to the hidden part of the sleeve or to the rear surface of the belt. It is contemplated that a secure and permanent means of connection be used to attach the fasteners to the sleeve or to the belt, such as stitching, bonding agents, adhesives, or a combination thereof. When a sleeve of the present invention is to be retrofitted onto an existing belt without permanent alteration to the belt, the sleeve would have a hidden surface with an elongated pocket that extends between the distal end of the sleeve and a transverse opening in the hidden surface of the sleeve that is close in position to the reinforced aperture used for insertion of the belt buckle's tongue. Also, the second part of a two-part quick-release fastener would be secured to the sleeve, and not to the belt, close to and distally positioned from the transverse opening used for insertion and withdrawal of the belt from the elongated pocket. In the alternative, a present invention sleeve could have a shortened hidden surface that would form a smaller pocket into which the non-buckle end of the belt is inserted during use. When a sleeve with a shortened pocket is used, the second part of the two-part quick-release fastener is attached to the belt. Attachment of the second fastener part to the belt can either be achieved during its manufacture, or retrofitted by the belt owner after manufacture. As a result, in a sleeve having a shortened pocket, instead of the belt being substantially encased within the sleeve's pocket, the central portion of the sleeve between the reinforced aperture and the pocket's opening would be pulled taut against the front surface of the belt. Sufficient lateral overlap of the exposed surface of the sleeve beyond the edges of the belt would prevent them from being visible to a casual observer. Other preferred embodiments could optionally comprise a selection of additional features, including but not limited to distal and proximal ends of various shapes, such as rounded, square, or tapered; various numbers and sizes of openings through both the hidden and exposed surfaces of the sleeve near to its distal end to facilitate rapid insertion of the buckle's tongue through both the sleeve and the belt during simultaneous closure of the belt and sleeve; and the openings through the distal end of the sleeve having configurations which are oval, round, square, or in the form of an elongated slot.

The sleeves of the present invention are easy to use and can be rapidly secured over and removed from an underlying belt when the width dimension of the belt is less than the width of the sleeve into which it is being inserted. Although not critical, typically for a preferred visual appearance the width dimension of a sleeve is no greater than approximately twice the width dimension of an underlying belt. In one preferred embodiment the non-buckle end of the belt is inserted into an elongated pocket through a transverse opening in the hidden side of the sleeve so that the hole in the non-buckle end of the belt needed for closure of the belt is accessible through longitudinal openings in the exposed and hidden surfaces in the distal end of the sleeve. It is important that the hidden surface of the sleeve is facing and aligned with the rear surface of the inserted belt. Also, when the underlying belt features a belt loop near its buckle, and particularly for small pocket embodiments, it is preferred that the buckle end of the sleeve is inserted through the belt loop, prior to being anchored to the belt buckle's tongue. Following insertion of the non-buckle end of the belt into the pocket in the distal end of the sleeve, and optional insertion of the buckle end of the sleeve through the belt loop or loops attached to the belt, the tongue of the belt buckle is angled forward into a position approximately perpendicular to the main body of the belt and inserted through the two reinforced apertures in the buckle end of the sleeve, one through the hidden surface of the sleeve and the other in an aligned position through the exposed surface of the sleeve. Optionally, the two reinforced apertures can be secured together through stitching or hardware (not shown) to form a single aperture for enhanced ease in insertion therethrough of the tongue. Subsequently, the buckle end of the sleeve is inserted through the central aperture of the belt buckle and brought behind the buckle to be fastened either to the hidden surface of the sleeve or to the rear surface of the portion of the belt exposed between the transverse opening and the reinforced aperture. Release of the belt from the sleeve would be rapid and simply require a parting of the two quick-release fastener parts, withdrawal of the buckle end of the sleeve backwards through the central opening in the belt buckle, removal of the tongue from the two optionally joined reinforced apertures in the buckle end of the sleeve, removal of the sleeve's buckle end from the belt loop when the belt loop is optionally used, and a sliding of the main body of the belt out and away from the pocket in the distal end of the sleeve. The removal process would therefore be quick and easy for a people having an average or greater than average level of coordination, and still manageable by those with some restriction in hand flexibility or movement, and children. Fasteners particularly suited for ease of use by children, such as hook-and-loop types of fasteners, could be used on all sleeves manufactured in sizes and with material designs appropriate for a child's belt. In most instances, except for the use of very expensive materials, use of the present invention sleeve to change the outward appearance of a belt would be lower in cost than the purchase of an entirely new belt. Also, although it is contemplated for the sleeves of the present invention to completely cover the front surface of an underlying belt during use, depending on the length of the pocket used in the sleeve, the rear surface of the belt can also be completely covered by the sleeve or varying portions of the rear surface can remain exposed. As a result, particularly in embodiments where a belt would be completed encased within a sleeve, frequent use of the present invention will reduce the amount of frictional contact applied to the side edges of the belt by the belt alignment loops of a garment, as well as by the belt buckle's tongue as the ends of the underlying belt are connected for use, and thereby protect the exterior surface of a favorite belt and extend its useful life. Further, the present invention has the advantage of using no separable small parts to attach the sleeve to the underlying belt that could become lost between uses, and requires no special tools to attach or detach a sleeve from an underlying belt. The sleeves of the present invention are further configured so that when each is in its optimum usable position upon an underlying belt, it will not interfere with the routine fastening of the belt or its garment support function. Thus the present invention can make any existing belt with a tongue and a width dimension slightly smaller than the width dimension of the sleeve into a more versatile fashion accessory.

The description herein provides preferred embodiments of the present invention but should not be construed as limiting the scope of the sleeves or their methods of construction. For example, variations in the type of material from which the sleeves are made; the number of pieces of sleeve material used during manufacture to construct each sleeve; the number of material layers used in each sleeve, such as the use of a contrasting panel to underlay a sheer or semi-sheer front sleeve panel or the use of interfacing; the color or type of reinforcement used around the transverse opening, the openings through the distal end of the sleeve, and the apertures used for insertion of the tongue to maintain the integrity of the surrounding material during repeated insertion and removal of the belt therefrom; the length dimension of the longitudinal openings on the distal end of the sleeve; the size of the pocket used for insertion and anchoring of the non-buckled end of the belt; the type of fastener used to secure the sleeve into its optimum usable position over a belt; the manner in which the fasteners are attached, connected, welded, adhered, or bonded to the sleeve and/or belt material; and the spaced-apart distance between the reinforced aperture and the transverse opening used for insertion of the belt, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 1:
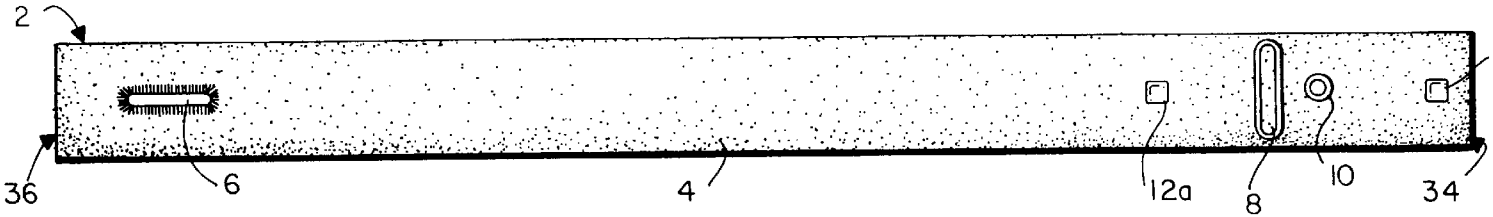
FIG. 1 is a back view of the hidden surface of a first preferred embodiment of a sleeve of the present invention having a transverse opening for belt insertion, a reinforced aperture, two cooperating parts of a two-part fastener, all near to the buckle end of the sleeve, and one longitudinal opening through its distal end.
Figure 9:
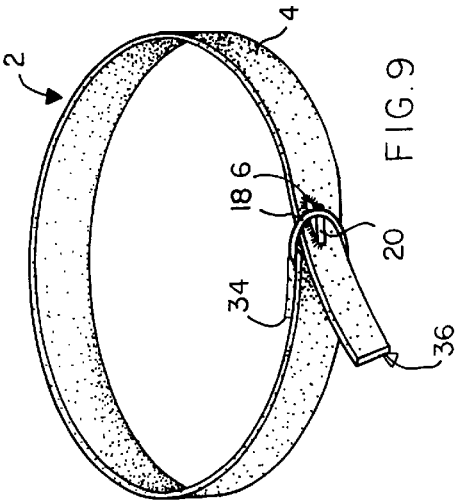
FIG. 9 is a perspective view of the sleeve of the present invention secured over an underlying belt with a fastened buckle.

FIG. 1 shows the hidden surface of a first preferred embodiment of a belt sleeve 2 of the present invention with a narrow longitudinal opening 6 near to its distal end 36, the second part 12*b* of a two-part fastener attached to the sleeve material 4 near to the buckle end 34 of sleeve 2, a reinforced aperture 10 at a spaced-apart distance from the second fastener part 12*b*, the first part 12*a* of the two-part fastener being at an independent spaced-apart distance from reinforced aperture 10, and a transverse opening 8 positioned between first fastener part 12*a* and reinforced aperture 10. The exposed surface of sleeve 2 is visible through transverse opening 8. Although not critical, in the preferred embodiment it is contemplated for the two-part fastener comprising first fastener part 12*a*, and second fastener part 12*b* to be a secure fastener that is quickly attached and rapidly releasable, such as a hook-and-loop type of fastener or a large snap. The spaced-apart distances between first fastener part 12*a*, transverse opening 8, reinforced aperture 10, and second fastener part 12*b* are not fixed and would depend upon the size of the belt buckle on the underlying belt contemplated for use, such as belt buckle 18 and underlying belt 14 shown in FIG. 3. Reinforced aperture 10 is used for insertion therethrough of the tongue of a belt buckle, as shown by the tongue 20 in FIG. 4, to anchor sleeve 2 in an optimum position relative to an underlying belt during use, such as belt 14 shown in FIG. 3. In the preferred embodiment it is contemplated that reinforced aperture 10 should be sufficiently large for easy insertion therethrough of tongue 20, however, reinforced aperture 10 should not be so overly large as to allow a lot of movement between reinforced aperture 10 and tongue 20 during use of sleeve 2. Transverse opening 8 is used to insert the underlying belt, such as belt 14 shown in FIG. 3, into sleeve 2. Transverse opening 8 should extend nearly the full width of sleeve material 4 and be somewhat narrow, however, not so narrow as to restrict movement of belt 14 as it is inserted into and withdrawn from the pocket formed between the exposed and hidden surfaces of sleeve 2. Depending upon the type of belt 14 used and its width relative to sleeve material 4, belt loop 22 could become inserted between the exposed and hidden surfaces of sleeve 2 during use and hidden from view, or conversely, sleeve material 4 could be inserted through belt loop 22 prior to the fastening of second fastener part 12*b* to first fastener part 12*a*, leaving belt loop 22 outside of sleeve 2 and ready for use in anchoring the distal end 36 of sleeve 2 after closure of belt 14 into the circular configuration shown in FIG. 9. For proper alignment of tongue 20 with reinforced aperture 10, the back surface of belt 14 should be facing and aligned with the hidden surface of sleeve 2. Narrow longitudinal opening 6 is used for closure of belt 14 into its usable circular configuration shown in FIG. 9. The tongue 20 of underlying belt 14 is inserted through narrow longitudinal opening 6, as shown in FIG. 9, the extended configuration of which allows easy location and alignment of tongue 20 with the belt hole most appropriate for closure, such as belt hole 30 shown in FIG. 6. Although not limited thereto, in the preferred embodiment it is contemplated for longitudinal opening 6 to have a maximum length dimension of approximately two inches and for longitudinal opening 6 to be sufficiently narrow so that a minimum amount of underlying belt 14 is visible therethrough. It is contemplated for narrow longitudinal opening 6, reinforced aperture 10, and transverse opening 8 all to have a reinforced edge to keep sleeve material 4 from becoming frayed or visibly worn with repeated use, such as, but not limited to, reinforcement through any of several common methods of hand or machine stitching used to bind buttonholes, the use of hardware such as a grommet or eyelet, the use of a combination of iron-on seam binding and stitching, or the use of overlapping material such as that used to make a tailored buttonhole. If hardware is used, in the preferred embodiment such hardware (not shown) would be made from durable, corrosion-resistant materials that resist oxidation and deterioration when exposed to commonly used laundry detergents, such as a rigid, durable plastic material or metal having a corrosion-resistant outer coating. The reinforcement means used for the edges of narrow longitudinal opening 6, reinforced aperture 10, and transverse opening 8 can be selected to have a color similar to that used in sleeve material 4 so that the reinforcement is not distinct from sleeve material 4. In the alternative, the reinforcement means can be selected to have a color contrasting to that used in sleeve material 4 to provide a fashion accent where desired. Further, the type and configuration of two-part fastener used for first fastener part 12*a* and second fastener part 12*b* is not critical, as long as it is an easy-to-use, quick-release fastener, to include but not be limited to various types of hook-and-loop fasteners, large two-part snaps, large hooks and eyes; magnetic fasteners, and the type of flat U-shaped skirt hooks used with a coordinating fiat bar having a width dimension sufficiently small for easy insertion into and release from the U-shaped part of the skirt hook. Although a hook-and-loop type of fastener is shown in FIG. 1 as first fastener part 12*a* and second fastener part 12*b*, the square configuration shown thereof in FIG. 1 is not critical and first fastener part 12*a* and second fastener part 12*b* could as easily have a circular, triangular, hexagonal, pentagonal, octagonal, or other perimeter configuration. The means used for attachment of first fastener part 12*a* and second fastener part 12*b* to sleeve material 4 will depend upon the type of fastener selected for use. However, it is contemplated for the attachment means used to securely and permanently connect first fastener part 12*a* and second fastener part 12*b* to sleeve material 4 to include but not be limited to stitching, adhesives, and bonding materials, or any combination thereof. Also, the number of two-part fasteners used is not critical, and particularly for the sleeves 2 used over very wide belts 14 or for bulky materials such as crushed velvet and fake fur, two or even three two-part part fasteners may be required for optimum use. However, in all preferred embodiments the number of first fastener parts 12*a* and second fastener parts 12*b* would be kept to a minimum to reduce manufacturing cost. Further, if more than two first fastener parts 12*a* and second fastener parts 12*b* are used, it is not required that all two-part fasteners used be identical in type, size, or configuration.

Figure 2:
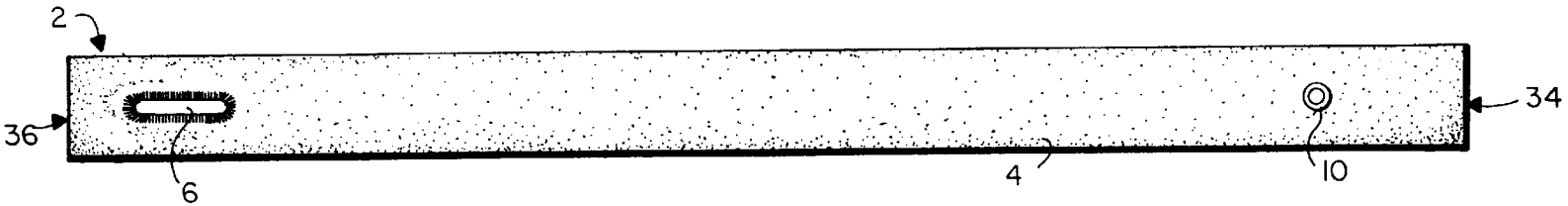
FIG. 2 is a front view of the exposed surface of a first preferred embodiment of a sleeve of the present invention having a reinforced aperture through its buckle end and one longitudinal opening through its distal end.
Figure 5:
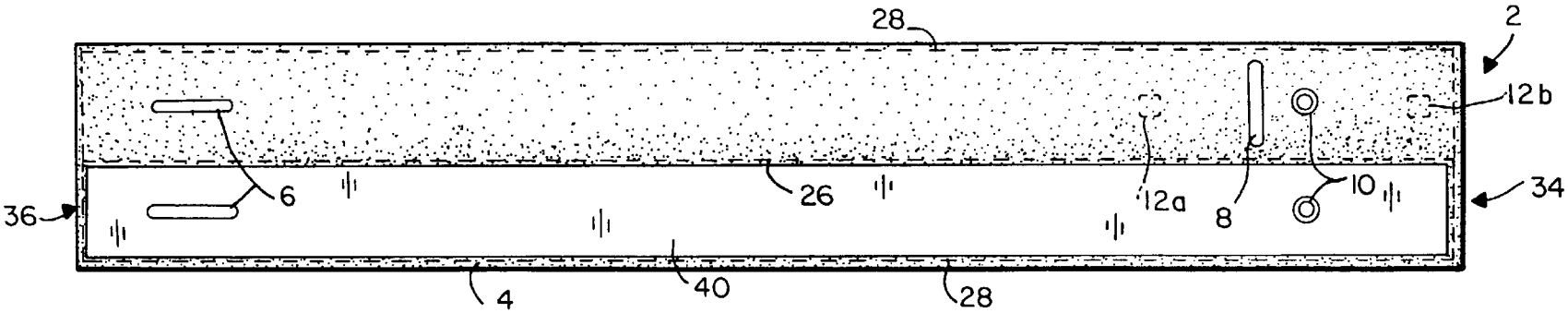
FIG. 5 is a top view of the inside surfaces of a second embodiment of the sleeve of the present invention prior to being stitched and configured into its usable form, wherein the front and back members of the sleeve are made from a single piece of material having a longitudinal fold line, and wherein a second layer of fabric is attached to the inside surface of the sleeve's front member.
Figure 10:
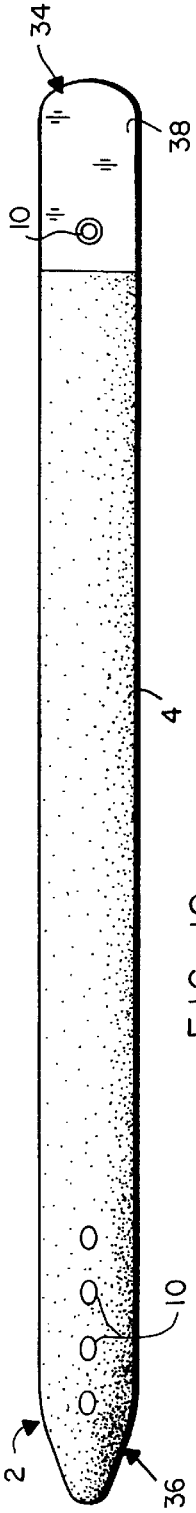
FIG. 10 is a front view of the exposed surface of a fourth preferred embodiment of a sleeve of the present invention having a rounded end and an opposed tapered end, an anchoring panel made from fabric that is different from the material used for the remainder of the exposed surface of the sleeve, and the reinforced aperture on the exposed surface of the sleeve being positioned through the anchoring panel.
Figure 11:
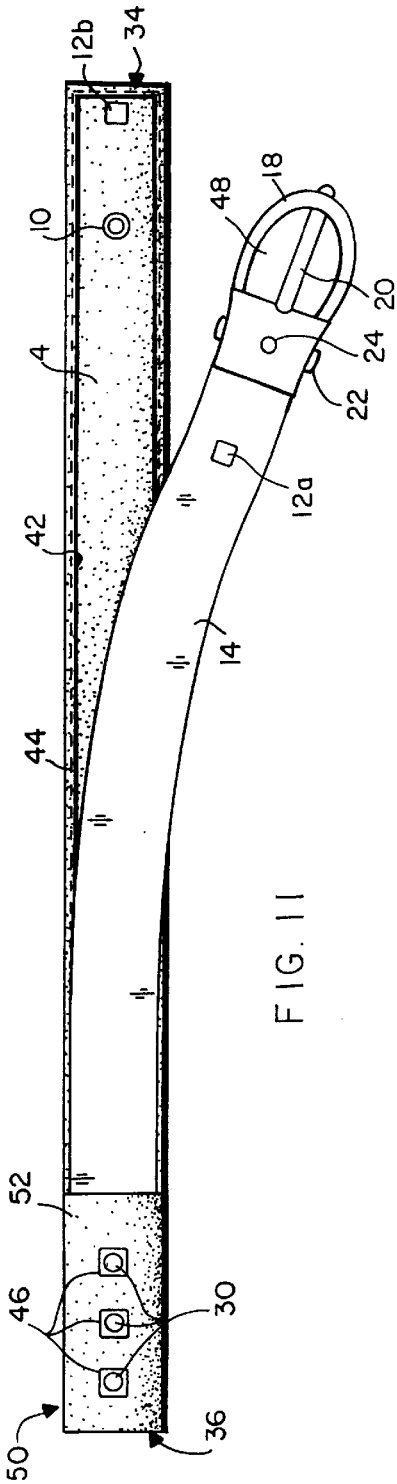
FIG. 11 is a rear view of a fifth preferred embodiment of a sleeve of the present invention with the non-buckle end of a belt inserted into a small pocket on the distal end of the sleeve, with the side edges of the sleeve as well as the edge on the buckle end of the sleeve being folded back upon themselves and stitched, in addition to one part of a two-part quick-release fastener being attached to the back side of the belt and several enlarged square openings on the hidden side of the sleeve pocket to facilitate insertion of the belt buckle's tongue through both the belt and the sleeve.
Figure 12:
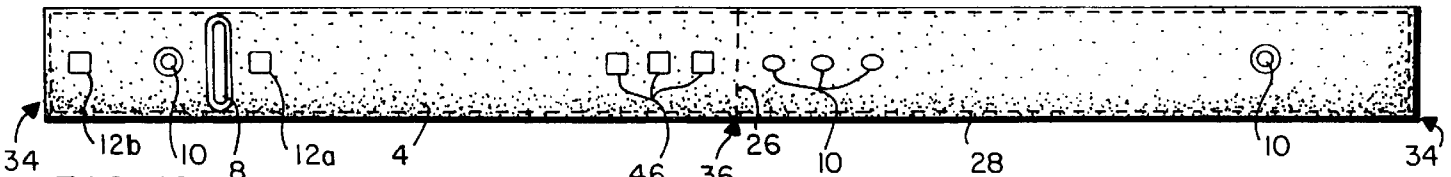
FIG. 12 is a top view of a sixth embodiment of the sleeve of the present invention prior to stitching wherein the front and back surfaces of the sleeve are made from a single piece of material having a central transverse fold line, and wherein the front and back surfaces of the sleeve are substantially similar in length.
Figure 13:
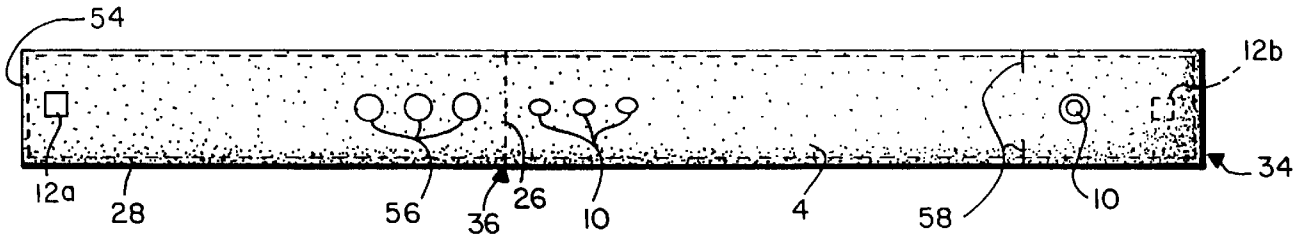
FIG. 13 is a top view of a seventh embodiment of the sleeve of the present invention prior to stitching wherein the front and back surfaces of the sleeve are made from a single piece of material having an offset transverse fold line, and further wherein the back surface of the sleeve has a shorter length dimension than the front surface of the sleeve.

The length of sleeve material 4 is not critical, however in the preferred embodiment it would extend no longer than approximately four inches beyond the length of the underlying belt 14 contemplated for use therewith. Also, in the preferred embodiment the width of sleeve material 4 can vary between a width dimension only slightly larger that the width dimension of the underlying belt, such as belt 14 shown in FIG. 3, or it can have a width dimension up to approximately twice the width dimension of underlying belt 14 without adversely affecting the appearance or function of either underlying belt 14 or sleeve 2. However, in the most preferred embodiment of the present invention it is contemplated for the width dimension of sleeve 2 to exceed the width dimension of underlying belt 14 by approximately one-fourth of an inch. When sleeve 2 is worn with a garment (not shown) having no belt alignment loops, the thickness of sleeve material 4 will be of minimal concern. However, when sleeve 2 is to be worn with a garment having belt alignment loops, the thickness of sleeve material 4 used should be taken into consideration, particularly that used for the hidden surface of sleeve 2, as shown in FIG. 1. The combined thickness of the sleeve material 4 used for the hidden and exposed surfaces of sleeve 2 should allow sleeve 2 and its underlying belt 14 to easily move through any belt alignment loops present in the garment (not shown) with which it is contemplated for sleeve 2 to be worn. When sleeve material 4 has a thin to moderate thickness dimension, both the hidden and exposed surfaces of sleeve 2 can be made from the same type of material 4, and even made from a single piece of material as shown in FIGS. 5, 12, and 13, if desired. Conversely, when the sleeve material 4 selected for the exposed surface of sleeve 2 is thick and/or bulky, such as crushed velvet or a fur-like material, in the preferred embodiment the hidden surface of sleeve 2 would generally be made from a less bulky material. A different fabric would also generally be used for the hidden surface of sleeve 2 when the material 4 selected for the exposed surface of sleeve 2 is expensive, hard to manipulate, or would otherwise be too delicate to be used alone in making a sleeve 2. Further, the exposed and hidden surfaces of sleeve 2 can be made from one piece of sleeve material 4 folded approximately in half longitudinally as shown in FIG. 5, one piece of sleeve material 4 folded end-to-end approximately in half as shown in FIGS. 12–15, two separate pieces of sleeve material 4 having identical dimensions as shown in FIGS. 1 and 2, or two or more separate pieces of sleeve material 4 having different overall dimensions as shown in FIGS. 5, 10, and 11. One option, when using two separate pieces of sleeve material 4 having different dimensions that form a small pocket between the exposed and hidden surfaces of sleeve material 4, is to provide a piece of sleeve material 4 for the exposed surface of sleeve 2 that is larger than the piece of sleeve material 4 provided for the hidden surface of sleeve 2 and then fold under and stitch the raw edges of the piece of sleeve material 4 provided for the exposed surface of sleeve 2 to the piece of sleeve material 4 provided for the hidden surface of sleeve 2 by using only two stitching lines. This would save manufacturing cost over an assembly process comprising the steps of placing a line of stitching on the reverse side of sleeve material 4, turning sleeve material 4 inside-out, and adding an additional line of stitching to the outside of sleeve 2 to close the remaining unseamed edge used for fabric reversal. The embodiment of sleeve 2 shown in FIG. 1 is comprised of exposed and hidden surfaces each having substantially similar overall dimensions. Although not shown in FIG. 1, top-stitching could be optionally added to sleeve 2 adjacent to its perimeter to strengthen the seams when loosely woven sleeve material 4 is used, seams less than one-half inch in width dimension are used, or for color contrast.

FIG. 2 shows the exposed surface of a first preferred embodiment of sleeve 2 having reinforced aperture 10 at a spaced-apart distance from the buckle end 34 of sleeve material 4 and narrow longitudinal opening 6 positioned near to the distal end 36 of sleeve material 4. Both reinforced aperture 10 and longitudinal opening 6 are positioned so as to become aligned with the reinforced aperture 10 and longitudinal opening 6 on the mated hidden surface of sleeve 2. Optionally, in place of longitudinal opening 6, several centered and longitudinally aligned apertures 10 could be positioned through sleeve material 4, similar to the four apertures 10 shown in FIG. 10 on the distal end 36 of sleeve 2. In the first preferred embodiment, the spaced-apart distance of reinforced aperture 10 from the buckle end 34 of sleeve material 4 is not fixed and would depend upon several factors including the size of the buckle 18 attached to the underlying belt 14, such as that shown in FIG. 3, and whether first fastener part 12*a* is attached to sleeve material 4, as in FIG. 1, or whether in the alternative first fastener part 12*a* is attached to the main body 16 of belt 14, as in FIG. 8. Since no part of belt 14 is inserted within sleeve 2 between transverse opening 8 and its buckle end 34, the two reinforced apertures 10 through the respective buckle ends 34 of the exposed and hidden surfaces of sleeve 2 could be joined together with a grommet (not shown) or stitching. In fact the joining of the two reinforced apertures 10 adjacent to buckle end 34 of sleeve 2 is preferred for easy one-step insertion of tongue 20 through both the exposed and hidden surfaces of sleeve 2. In contrast, the two longitudinal openings 6 through the distal ends 36 of the exposed and hidden surfaces of sleeve 2 cannot be joined, and must remain separated from one another so that the non-buckle end of underlying belt 14 can be placed therebetween to allow tongue 20 to become inserted through one of the holes in the non-buckle end of the underlying belt 14, such as holes 30 in FIG. 6, to connect the opposing ends of the underlying belt 14 to one another to form the circular usable configuration of belt 14 and sleeve 2 shown in FIG. 9. Although not shown, it is also contemplated for the front surface of sleeve 2 to comprise more than one layer of fabric, such as but not limited to instances in which the outermost layer of the exposed surface of sleeve 2 would be made from sheer or semi-sheer material 4 and it is desired to place a contrasting layer of sleeve material 4 directly beneath the sheer or semi-sheer layer to accentuate it.

Figure 4:
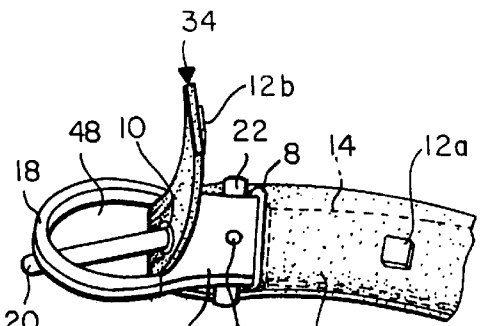
FIG. 4 is a perspective view of the first embodiment sleeve being inserted through the belt loop and buckle of an underlying belt, with the tongue of the buckle engaging the reinforced aperture, prior to connection of the cooperating parts of the two-part fastener.
Figure 3:
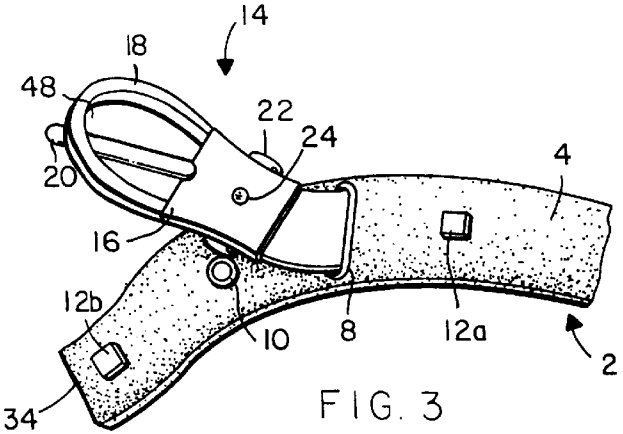
FIG. 3 is a perspective view of a belt being inserted through the transverse opening in the first embodiment sleeve of the present invention with the rear surface of the belt facing the hidden surface of the sleeve, the tongue not yet inserted through the reinforced aperture.

FIG. 3 shows a belt 14 being inserted through transverse opening 8 on the hidden surface of a sleeve 2 in the first embodiment of the present invention. The rear surface of belt 14 is facing and aligned with the hidden surface of sleeve 2. FIG. 3 shows first fastener part 12*a* attached to the hidden surface of sleeve material 4 near to transverse opening 8 and in a position distally from transverse opening 8. Second fastener part 12*b* is also attached to the hidden surface of sleeve material 4 near to its buckle end 34. FIG. 3 further shows belt 14 having a buckle 18, a tongue 20 connected centrally and longitudinally across buckle 18, the main body 16 of belt 14, a belt loop 22 connected transversely across main body 16 near to the pivoting end of tongue 20, and the end of main body 16 being folded back upon itself and secured by a centrally positioned rivet 24. When belt 14 has a belt loop 22, as shown in FIG. 3, unless the width of belt 14 is substantially less than transverse opening 8, the portion of main body 16 containing belt loop 22 generally does not become inserted into transverse opening 8 and remains extending beyond transverse opening 8 where it can be used to anchor the distal end 36 of sleeve material 4 during use, if desired, as shown in FIG. 4. However, even though a portion of main body 16 may not be inserted between the exposed and hidden surfaces of sleeve 2 during use, that portion becomes covered by the buckle end 34 of sleeve 2 as buckle end 34 is pulled through the central opening 48 in buckle 18 and folded back toward the hidden surface of sleeve 2 to allow second fastener part 12*b* to become aligned with and connected to first fastener 12*a*.

Figure 6:
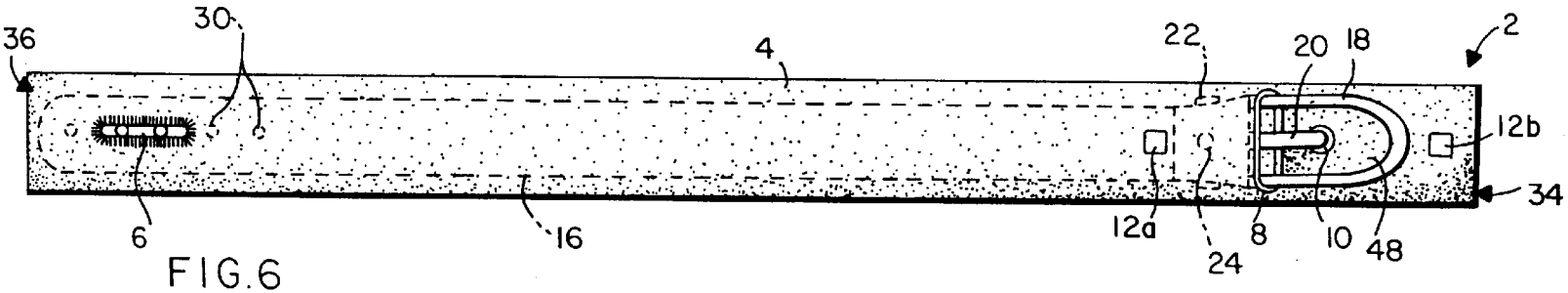
FIG. 6 is a back view of a belt with multiple holes through its non-buckle end being inserted into a sleeve of the present invention with the tongue of the belt's buckle inserted through the reinforced aperture prior to insertion of the buckle end of the sleeve through the central aperture of the buckle, and the belt loop and rivet becoming hidden within the sleeve when the two fasteners parts are secured to one another.

FIG. 4 shows reinforced aperture 10 of the first preferred embodiment of the present invention being engaged with the tongue 20 of a belt buckle 18. Second fastener part 12*b* is poised for attachment to first fastener part 12*a*. When second fastener part 12*b* becomes attached to first fastener part 12*a*, sleeve material 4 will completely cover the main body 16 of the underlying belt 14, including the portion of main body 16 having rivet 24. As shown in FIG. 4, belt loop 22 would preferably remain outside of sleeve 2. However, when the width dimension of belt 14 is sufficiently smaller than the width dimension of sleeve material 4, belt loop 22 and rivet 24 can be inserted within the pocket formed between the hidden and exposed surfaces of sleeve 2, as shown in FIG. 6. While not visible in FIG. 4, but more clearly shown in FIG. 7, as the buckle end 34 of sleeve material 4 containing second fastener part 12*b* is drawn through opening 48 in buckle 18, buckle end 34 becomes slightly gathered as the width of sleeve material 4 is made sufficiently narrow to pass through the central opening 48 of buckle 18. The gathered portion of sleeve material 4 would remain only in the immediate area of tongue 20, as the portion of sleeve material 4 extending behind belt loop 22 and rivet 24 would need to be spread out laterally for a secure and non-bulky connection to the hidden surface of sleeve 2.

FIG. 5 shows a second preferred embodiment of the present invention, prior to stitching, wherein the exposed and hidden surfaces of sleeve 2 are made from a single piece of sleeve material 4. A longitudinally oriented central fold line 26 is shown separating the exposed and hidden surfaces of sleeve 2, with the hidden surface shown in a position above the exposed surface. FIG. 5 also shows seam lines 28 adjacent to the entire perimeter edge of sleeve material 4. Although not critical, in the most preferred embodiment seam lines 28 would be positioned approximately one-half inch from the perimeter edge of sleeve material 4. Also, for most purposes the minimum distance between seam lines 28 and the perimeter edge of sleeve material 4 would be approximately one-fourth of an inch. When sleeve 2 is constructed from the sleeve material 4 shown in FIG. 5, several stitching options are possible. One preferred stitching option would leave sleeve 2 with stitched seam lines 28 on three of its four edges, with the remaining top or bottom edge of sleeve 2 being simply folded instead of stitched. It is not critical whether the folded edge becomes the top or bottom edge of sleeve 2 during use. In the first preferred stitching option, two edges of sleeve 2 could have traditional seams stitched on the reverse side of the fabric, with the third edge being top-stitched. To accomplish this, sleeve material 4 would be reverse folded so that right sides of sleeve material 4 are facing one another. Then the seam lines 28 opposed to fold line 26 and the seam lines 28 on one end of sleeve material 4 would be stitched together to join the hidden and exposed surfaces of sleeve 2 to one another. Sleeve material 4 would then be turned right-side-out, followed by the folding under of the remaining raw edge used for reversal of sleeve material 4, after which the folded sleeve material 4 would be top-stitched close to the perimeter edge of sleeve 2. In the alternative, the three stitched edges could all be top-stitched. To accomplish this, the raw edges of sleeve material 4 adjacent to the seam lines 28 on the three stitched edges could be folded to the inside of sleeve 2 prior to stitching, and then top-stitched close to the perimeter edge of sleeve 2. This procedure is preferred as the intermediate step of turning sleeve material 4 right-side-out is omitted. Although not critical, when two edges of sleeve material 4 have traditionally stitched seams and one edge is top-stitched, in the most preferred embodiment buckle end 34 would be selected for top-stitched closure since it remains hidden from view during use. Another preferred stitching option for the preferred embodiment shown in FIG. 5, and which provides additional stability to the construction of sleeve 2, prior to stitching the perimeter seams on seam lines 28 by one of the methods previously disclosed, center line 26 would be reverse folded and stitched while the two outside surfaces of sleeve material 4 are facing one another. Thereafter, when seam lines 28 on remaining three edges are stitched, all four of the edges of the finished sleeve 2 would appear to comprise a traditionally stitched seam. For decorative purposes, or as a further option for providing additional stability to the construction of sleeve 2, particularly when loosely woven sleeve materials 4 are used, and to help prevent the exposed and hidden surfaces of sleeve 2 from becoming misaligned with one another during repeated use and laundering, top-stitching could be added to any of the four perimeter edges of sleeve 2 after the initial attachment of the exposed and hidden surfaces of sleeve 2 to one another. In the most preferred embodiment, top-stitching would be positioned approximately one-fourth of an inch from each finished edge of sleeve 2.

FIG. 5 also shows the two longitudinal openings 6 through the distal end 36 of sleeve material 4, each having the same length dimension and being aligned with one another. One of the longitudinal openings 6 is centered between the side edges of the exposed surface of sleeve 2, while the other is centered the between the side edges of the hidden surface of sleeve 2. Reinforcement of both longitudinal openings 6 would be separately provided prior to the stitching of seam lines 28. FIG. 5 further shows one transverse opening 8 positioned near to the buckle end 34 of sleeve material 4 on the hidden surface of sleeve 2 and extending substantially across the hidden surface between seam line 28 and fold line 26. Reinforcement of transverse opening 8 would also be provided prior to stitching seam lines 28. In addition FIG. 5 shows a two-part fastener, with first fastener part 12*a* positioned near to transverse opening 8 between longitudinal opening 6 and transverse opening 8, while second fastener part 12*b* is positioned near to the buckle end 34 of sleeve material 4. Since FIG. 5 shows the inside surface of sleeve material 4, while the right side of sleeve material 4 remains in an opposed hidden position and first fastener part 12*a* and second fastener part 12*b* would be attached to the right side of sleeve material 4, first fastener part 12*a* and second fastener part 12*b* are shown in FIG. 5 with broken lines to indicate their concealment from view. Both first fastener part 12*a* and second fastener part 12*b* are centered between seam line 28 and fold line 26 on the hidden surface of sleeve material 4. In the alternative, and particularly contemplated for wider sleeves 2 although not limited thereto, multiple two-part quick-release fasteners could be used. Additional first fastener parts 12*a* and second fasteners parts 12*b*, need not be the same size, type, or configuration as those in the other two-part fasteners used. FIG. 5 also shows the two reinforced apertures 10 near the buckle end 34 of sleeve material 4, close to transverse opening 8 and positioned proximally from transverse opening 8. Both of the reinforced apertures 10 shown in FIG. 5 are approximately the same size and aligned with one another on sleeve material 4. Although both reinforced apertures 10 must be aligned, it is not critical that they be identical in size or shape, and the reinforced aperture 10 through the hidden surface of sleeve material 4 could be larger and square, similar to the large square openings 46 shown in FIG. 11. One of the reinforced apertures 10 is centered between the side edges of the exposed surface of sleeve 2, while the other reinforced aperture 10 is centered the between the side edges of hidden surface of sleeve 2. Reinforcement of both reinforced apertures 10 could be separately provided prior to stitching seam lines 28 or provided subsequent to the stitching of seam lines 28. Providing the reinforcement for both reinforced apertures 10 simultaneously after stitching seam lines 28, so that the two reinforced apertures 10 become joined to one another, although not critical, would facilitate insertion of tongue 20 through reinforced apertures 10 by making it a one-step process rather than requiring two separate insertion steps, a first step comprising insertion of tongue 20 through the hidden surface of sleeve material 4, with a second step of blindly finding the second reinforced aperture 10 and subsequent insertion of the tongue 20 through the exposed surface of sleeve material 4. Although distal end 36 and buckle end 34 are shown in FIG. 5 to have a square configuration, it is also contemplated for distal end 36 and buckle end 34 to have other configurations, such as but not limited to a rounded or tapered configuration, as shown in FIG. 10. Also, interfacing, facing, or other means of stiffening sleeve material 4 or the providing of a contrasting liner for sheer or semi-sheer sleeve materials 4 for color accent can be optionally used, as shown by the number 40 in FIG. 5. It would not be required for fabric 40 to extend completely between distal end 36 and buckle end 34, although fabric 40 should at least extend between distal end 36 and reinforced aperture 10.

FIG. 6 shows a belt 14 having two holes 30 on the non-buckle end of main body 16 exposed through longitudinal opening 6 for engagement with tongue 20 to allow belt 14 to achieve the usable circular configuration shown in FIG. 9 after belt 14 is inserted into transverse opening 8 in sleeve 2. Tongue 20 is inserted through the reinforced aperture 10 near to the buckle end 34 of sleeve 2. In FIG. 6, the sleeve material 4 under buckle 18 is shown in an extended flat configuration, prior to insertion of buckle end 34 through the central opening 48 in buckle 18. First fastener part 12*a* remains unattached to second fastener part 12*b*. Although not critical to the present invention, FIG. 6 shows the width dimension of sleeve material 4 sufficiently larger than the width dimension of belt 14 to allow belt loop 22 and rivet 24 to become inserted through transverse opening 8 and positioned in the pocket formed between the hidden and exposed surfaces of sleeve 2. In FIG. 6, the length dimension of longitudinal opening 6 allows two of five belt holes 30 in belt 14 to be available for engagement with tongue 20. Although the length of longitudinal opening 6 and the number of exposed belt holes 30 are not critical, in the most preferred embodiment of the present invention the length of longitudinal opening 6 would be sufficient to allow no more than two belt holes 30 to be exposed therethrough.

Figure 7:
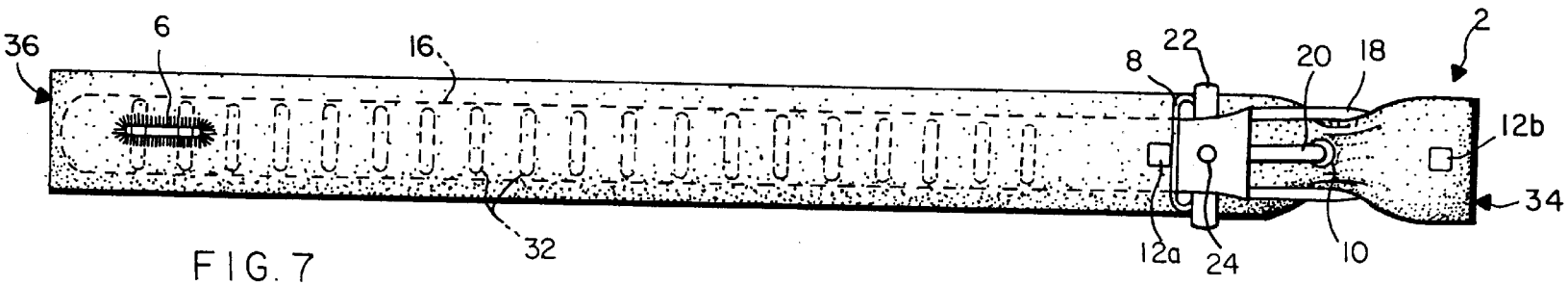
FIG. 7 is a back view of a belt with transverse slots being inserted into a sleeve of the present invention with the tongue of the belt's buckle inserted through the reinforced aperture and with the buckle end of the sleeve inserted through the central aperture of the buckle prior to connection of the two-part fastener that secures the sleeve in an optimum position relative to the underlying belt, the sleeve also being inserted through the belt loop of the belt.

FIG. 7 shows the main body 16 of a belt 14 having transverse slots 32 therethrough inserted into transverse opening 8 in sleeve 2 with the non-buckle end of main body 16 extending beyond longitudinal opening 6 to a position in close proximity to the distal end 36 of sleeve 2. The central portions of two transverse slots 32 near to the non-buckle end of main body 16 are exposed through narrow longitudinal opening 6. Use of a belt 14 with transverse slots 32 as a means for securing belt 14 in its usable circular configuration permits easier and faster insertion of tongue 20 successively through sleeve material 4 and belt 14 than would be accomplished through use of a belt 14 having small belt holes 30, as shown in FIG. 6. Although the length of longitudinal opening 6 and the number of transverse slots 32 exposed therethrough are not critical, in the most preferred embodiment of the present invention the length of longitudinal opening 6 would be sufficient to allow only two transverse slots 32 to be easily accessible for engagement of tongue 20. Also, although FIG. 7 shows main body 16 having uniformly spaced-apart transverse slots 32 substantially along its entire length to provide an aesthetically pleasing design for main body 16, for use with sleeve 2 only two or three transverse slots 32 would be needed on main body 16 as long as they were positioned near to the non-buckle end of main body 16 for accessibility through longitudinal slot 6 and possible engagement with tongue 20. FIG. 7 shows tongue 20 inserted through reinforced aperture 10 and the buckle end 34 of sleeve material 4 inserted through opening 48 in buckle 18, ready for the folding of buckle end 34 toward the hidden surface of sleeve 2 and connection of second fastener part 12*b* to first fastener part 12*a*. When second fastener part 12*b* is firmly positioned against first fastener part 12*a*, sleeve 2 will become securely placed into its optimum position relative to belt 14. Although not critical to the present invention, FIG. 7 shows the width dimension of sleeve material 4 substantially larger than the width dimension of belt 14, with belt loop 22 and rivet 24 remain outside of transverse opening 8 and not positioned within the pocket formed between the hidden and exposed surfaces of sleeve 2. In FIG. 7, as the buckle end 34 of sleeve material 4 containing second fastener part 12*b* is drawn through the central opening 48 in buckle 18, buckle end 34 becomes slightly gathered as the width of sleeve material 4 is narrowed to allow it to easily pass through the central opening 48 of buckle 18. The gathered portion of sleeve material 4 would remain only in the immediate area of tongue 20, as the portion of sleeve material 4 extending beyond belt loop 22 and rivet 24 would need to be spread out laterally for a secure, flat, and non-bulky connection to the hidden surface of sleeve 2.

Figure 8:
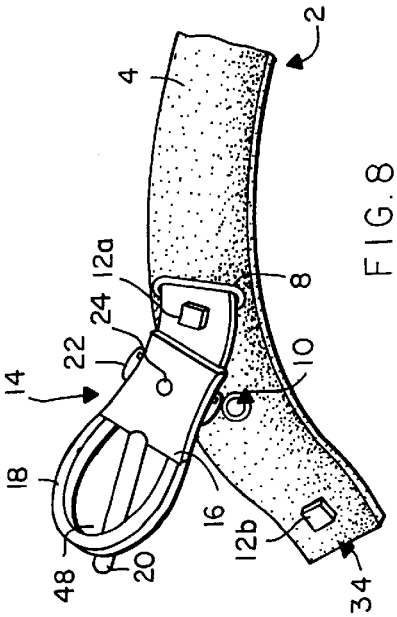
FIG. 8 is a perspective view of a belt being inserted through the transverse opening in the third embodiment of the sleeve of the present invention wherein the second part of a two-part fastener is attached to the rear surface of the belt, with the rear surface of the belt facing the hidden surface of the sleeve.

FIG. 8 shows belt 14 being inserted through transverse opening 8 on the hidden surface of a sleeve 2 in the third embodiment of the present invention. The rear surface of belt 14 is facing and aligned with the hidden surface of sleeve 2. FIG. 8 also shows first fastener part 12*a* attached to the rear surface of belt 14 instead of being attached to sleeve material 4. Second fastener part 12*b* is attached to sleeve material 4 near to its buckle end 34. Such positioning of first fastener part 12*a* to belt 14 allows a more secure attachment between sleeve 2 and belt 14. The connection means for securing first fastener part 12*a* to the rear surface of belt 14 is not critical and can be accomplished by adhesives, bonding agents, stitching, or a combination thereof. Also the type of two-part quick-release fastener used for first fastener part 12*a* and second fastener part 12*b* in the third embodiment of the present invention is not critical. However, in the preferred embodiment shown in FIG. 8, first fastener part 12*a* would be the looped member of a hook-and-loop type of fastener, and the attachment means to connect first fastener 12*a* to main body 16 would be an adhesive or bonding agent. FIG. 8 further shows belt 14 having a buckle 18, a tongue 20 connected centrally within buckle 18, the main body 16 of belt 14, a belt loop 22 connected transversely across the front surface of main body 16 near to tongue 20, and the end of main body 16 folded back upon itself and secured by a centrally positioned rivet 24.

FIG. 9 shows sleeve 2 of the present invention secured in a circular configuration by fastened buckle 18 with tongue 20 being inserted through longitudinal opening 6. The underlying belt 14 is completely hidden from view by sleeve material 4. In the alternative, buckle end 34 could be inserted through belt loop 22 to have belt loop 22 in plain view and available for securing distal end 36. FIG. 9 also shows buckle end 34 being folded back behind sleeve material 4. The distal end 36 of sleeve material 4 extends through buckle 18 and is shown extending toward the same side of buckle 18 where buckle end 34 is located. When the present invention is worn with a garment (not shown) having belt alignment loops, such belt alignment loops can be used to position distal end 36 into an approximately parallel position with buckle end 34 during use. When the present invention is worn with a garment not having belt alignment loops, (not shown), such as a shirt, dress, or coat, distal end 36 can optionally be secured in front of buckle end 34 in a position approximately parallel thereto during use with one or more snaps, small hooks and eyes, small magnetic fasteners, or other similar types of fastener.

FIG. 10 shows the hidden surface of a fourth preferred embodiment of the present invention having an anchoring panel 38 made from a different fabric than the sleeve material 4 used for the remainder of sleeve 2. FIG. 10 also shows four reinforced apertures 10 positioned near to the distal end 36 of sleeve material 4 for use in engaging tongue 20 of buckle 18, as shown in FIG. 11, to close belt 14 and sleeve 2 into their usable circular configurations, with one additional reinforced aperture 10 positioned within anchoring panel 38 close to the interface between anchoring panel 38 and sleeve material 4. In the preferred embodiment it is contemplated for anchoring panel 38 to be made from a thin flexible fabric and used when sleeve material 4 comprises thick, bulky, or expensive fabrics. When an anchoring panel 38 made from a thin fabric is used with thick or bulky sleeve materials 4, anchoring panel 38 enhances the comfort of wearing sleeve 2. When an anchoring panel 38 is used with expensive sleeve materials 4, anchoring panel 38 helps to reduce the overall cost of sleeve 2. Since as shown in FIG. 9 distal end 36 would overlap the portions of sleeve 2 adjacent to longitudinal opening 6, no part of anchoring panel 38 would not be visible to a casual observer of sleeve 2 while it is in use.

FIG. 11 shows a fifth preferred embodiment of the present invention as a short-pocketed sleeve 50, with the non-buckle end of belt 14 inserted into a small pocket 52 formed in the distal end 36 of sleeve 50. The remaining sleeve material 4 extending beyond small pocket 52 toward buckle end 34 contains folded edges 42 secured with stitching 44. Although not shown, when the buckle end 34 and distal end 36 of sleeve 50 are rounded or tapered, or otherwise have an arcuate configuration, it is contemplated that folded edges 42 on the arcuate portions will have to be clipped in several places perpendicular to seam line 28, but not beyond seam line 28, to ease the curvature of sleeve material 4 during the application of stitching 44 and provide a neat appearance on the exposed surface of sleeve 50. FIG. 11 also shows the rear surface of belt 14 being aligned with the hidden side of pocket 52, and first fastener part 12*a* attached to the rear surface of belt 14 instead of being attached to sleeve material 4. Second fastener part 12*b* is attached to the inside surface of sleeve material 4 near to its buckle end 34. This allows sleeve 50 to become directly attached to belt 14 when tongue 20 is inserted through reinforced aperture 10 for a more stable and secure connection therebetween. The attachment means for securing first fastener part 12*a* to the back surface of belt 14 is not critical and can be accomplished by adhesives, bonding agents, stitching, or a combination thereof. Also the number, size, and type of fastener used for first fastener part 12*a* is not critical. FIG. 11 further shows belt 14 having a buckle 18, a tongue 20 connected centrally within buckle 18, an opening 48 through buckle 18, a belt loop 22 connected transversely across the front surface of belt 14 near to the pivotal connection of tongue 20, and the end of belt 14 folded back upon itself and secured by a centrally positioned rivet 24. In addition, although not critical, FIG. 11 shows distal end 36 and buckle end 34 having a square configuration, with pocket 52 having three spaced-apart square holes 46 each centrally positioned longitudinally on pocket 52, and each being shown larger than the underlying belt holes 30 aligned therewith. The configuration of holes 46 is not critical and holes 46 could also have a round or oval shape as long as each remained larger than belt holes 30 to facilitate rapid insertion of tongue 20 through both holes 46 and belt holes 30. The number of holes 46 used is also not critical but would depend at least in part on the length of pocket 52. For most purposes three holes 46 would be adequate for ease of use and preferred to simplify manufacture. Although not shown in FIG. 11, three reinforced apertures 10 would be present in the exposed surface of sleeve material 4, also each being aligned with a different one of the belt holes 30 and a different hole 46. As with the other preferred embodiments described hereinabove, although a portion of the rear surface of belt 14 is not contained between opposing surfaces of sleeve 50, when sleeve 50 is fully attached to belt 14 and in its usable position, the main body of belt 14 is entirely hidden from view with only a portion of buckle 18 and tongue 20 remaining visible. Belt loop 22 can also remain visible when used to anchor sleeve material 4. Also, although not shown in FIG. 11, belt 14 could be made from a metallic material and magnetic strips could be secured to the back surface of sleeve material 4 to enhance the attachment of sleeve 50 to belt 14.

Figure 14:
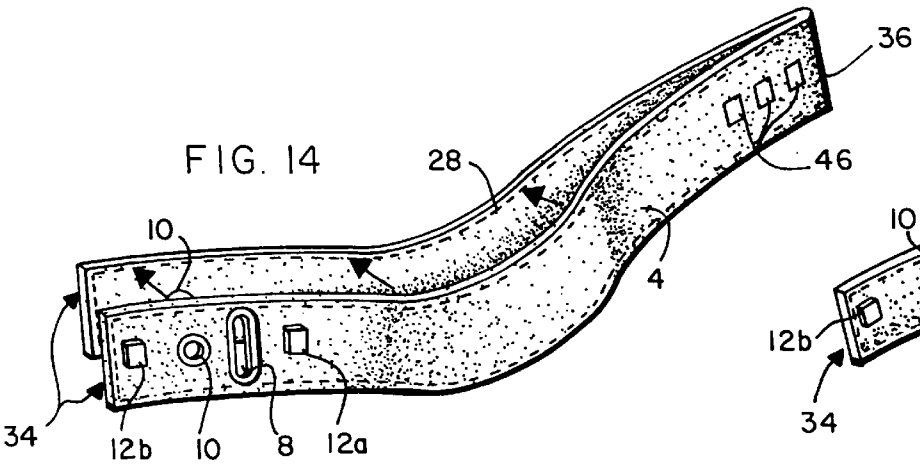
FIG. 14 is a perspective view of the sixth embodiment of the sleeve of the present invention prior to stitching, wherein the sleeve material is folded so that the front and back surfaces of the sleeve are in positions of near alignment with one another.

FIGS. 12 and 14 show a sixth embodiment of the present invention wherein the exposed and hidden surfaces of sleeve material 4 have a common distal end 36. The identity of the connected end is not critical, and although not shown, it is also contemplated for the exposed and hidden surfaces of sleeve material 4 to alternatively have a common buckle end 34. FIG. 12 shows sleeve material 4 in a flattened orientation prior to stitching, while FIG. 14 shows the two buckle ends 34 of sleeve material 4 in close alignment with one another, the exposed surface of sleeve material 4 positioned behind the hidden surface of sleeve material 4, and the exposed and hidden surfaces substantially aligned with one another prior to stitching along seam lines 28. It is not critical whether the edges of sleeve material 4 are folded under and stitched along seam lines 28 with the right sides of sleeve material 4 facing outward, or whether the right sides of sleeve material 4 are reversed and positioned facing one another during stitching, with sleeve material 4 being turned inside out after stitching to expose the right sides of the exposed and hidden surfaces of sleeve material 4, followed by application of stitching to close the portion of seam line 28 left previously unstitched for reversal so that sleeve material 4 is turned right-side-out. FIGS. 12 and 14 also show one reinforced aperture 10 at a space-apart distance from buckle end 34 and a second reinforced aperture 10 positioned at a nearly identical spaced-apart distance from the opposed buckle end 34. Three additional reinforced apertures 10 having a slightly oval configuration are shown in FIG. 12 positioned near to the distal end 36 of the exposed surface of sleeve material 4. The orientation of sleeve material 4 in FIG. 14 does not permit viewing of the three additional reinforced oval apertures 10. FIGS. 12 and 14 each show three square openings 46 positioned near to distal end 36 on the hidden surface of sleeve material 4, with each square opening 46 aligned with a different one of the three additional reinforced oval apertures 10. Fold line 26 shown in FIG. 12 is positioned equidistant between the two buckle ends 34 of sleeve material 4. FIGS. 12 and 14 each also show one centrally positioned two-part fastener close to the buckle end 34 of the hidden surface of sleeve material 4 with first fastener part 12*a* and second fastener part 12*b* positioned on opposite sides of reinforced aperture 10. FIGS. 12 and 14 also show a transverse opening 8 positioned near to distal end 34 through the hidden surface of sleeve material 4 between reinforced aperture 10 and first fastener part 12*a*.

Figure 15:
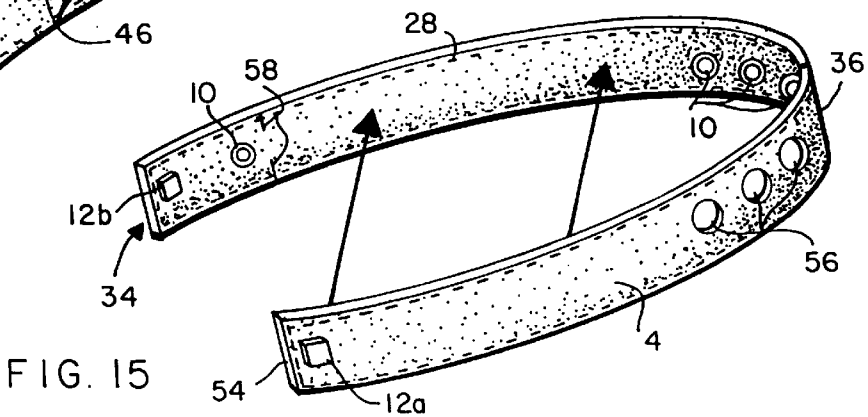
FIG. 15 is a perspective view of the seventh embodiment of the sleeve of the present invention, wherein prior to stitching the front and back surfaces of the sleeve are in the process of being folded and aligned.

FIGS. 13 and 15 show a seventh embodiment of the present invention wherein the exposed and hidden surfaces of sleeve material 4 also have a common distal end 36. The identity of distal end 36 as the common end is critical in the seventh preferred embodiment as the hidden surface of sleeve material 4 has a shortened end 54, making the hidden surface of sleeve material 4 shorter than the exposed surface of sleeve material 4. In the embodiment shown in FIGS. 13 and 15, sleeve material 4 would necessarily extend through belt loop 22 prior to attachment of second fastener part 12*b* to first fastener part 12*a,* so that belt loop 22 could be used as an additional anchoring point to secure the distal end 36 of sleeve 2 during use. FIG. 13 shows sleeve material 4 in a flattened orientation prior to stitching, while FIG. 15 shows the shortened end 54 positioned for attachment to the exposed surface of sleeve material 4 near to cutting lines 58. The seam lines 28 marked between cutting lines 58 and shortened end 54 would be used to attach the exposed and hidden surfaces of sleeve material 4 to one another. Conversely, the seam lines 28 between cutting lines 58 and buckle end 34 would be used to provide a folded and top-stitched edge on sleeve material 4. It is not critical whether the edges of sleeve material 4 between cutting lines 58 and shortened end 54 are folded under and stitched along seam lines 28 with the right sides of sleeve material 4 facing outward, or whether the right sides of sleeve material 4 are positioned facing one another during stitching, with sleeve material 4 being subsequently turned right-side-out for use. FIGS. 13 and 15 also show one reinforced aperture 10 at a spaced-apart distance from buckle end 34 for use in engagement with the tongue 20 of a belt buckle 18. Three additional reinforced apertures 10 shown in FIGS. 13 and 15 are positioned near to the distal end 36 of the exposed surface of sleeve material 4. The reinforced apertures 10 in FIG. 13 are each shown with a slightly oval configuration, however, the configuration of such reinforced apertures 10 is not critical. FIGS. 13 and 15 each further show three enlarged round openings 56 positioned near to distal end 36 on the hidden surface of sleeve material 4, with each enlarged round opening 56 aligned with a different one of the three reinforced apertures 10. Fold line 26 shown in FIG. 12 is not positioned equidistant between the buckle end 34 and shortened end 54, but offset to make the hidden surface of sleeve material 4 shorter than the exposed surface of sleeve material 4 so that the reinforced aperture 10 adjacent to buckle end 34 remains available for use in securing tongue 20, as shown in FIG. 11. FIGS. 13 and 15 also show one two-part fastener attached to sleeve material 4 with first fastener part 12*a* attached to the right side of the hidden surface of sleeve material 4 close to shortened end 54, with second fastener part 12*b* attached on the opposite side of sleeve material 4, to the inside of the exposed surface of sleeve material 4 close to buckle end 34. When shortened end 54 becomes aligned with cutting lines 58, first fastener part 12*a* and second fastener part 12*b* become positioned on opposite sides of reinforced aperture 10. Although not shown in FIG. 15, the connection of shortened end 54 to the exposed surface of sleeve material 4 near to cutting lines 58 would create an opening similar to transverse opening 8 shown in FIG. 12 for use in inserting the non-buckle end of belt 14 into the pocket between the exposed and hidden surfaces of sleeve 2 or 50. Cutting lines 58 are clipped with scissors, a razor blade, or other sharp tool (not shown) after stitching of the hidden and exposed surfaces of sleeve material 4 to one another along seam lines 28 and used to make the transition between the two-layer distal, pocketed portion of the present invention and the one-layered buckle end 34.

To make the first embodiment of sleeve 2, wherein the hidden and exposed surfaces of sleeve 2 are separate from one another, identical longitudinal openings 6 would be made through each near to its distal end 36. Although the length of longitudinal openings 6 is not critical, in most preferred embodiments the maximum length dimension of each longitudinal opening 6 would be approximately two inches. A two-inch length would usually provide convenient access to approximately two or three belt holes 30 or transverse slots 32. Also, it is contemplated for the width of longitudinal openings 6 to be somewhat narrow so as to minimally expose underlying belt 14 therethrough. Although longitudinal openings 6 could be either cut first and then reinforced, in the preferred embodiment longitudinal openings 6 would generally be reinforced first with stitching or appropriate hardware (not shown) and later cut to form a pass-through opening in sleeve material 4. Only in the hidden surface of sleeve 2 and at a designated distance from its buckle end 34, usually four inches in the preferred embodiment, a transverse opening 8 would be made for insertion of a belt 14 into the pocket formed between the exposed and hidden surfaces of sleeve 2. The length of transverse opening 8 would substantially span across the width of the hidden surface of sleeve 2. Again as with longitudinal opening 6, transverse opening 8 could be either cut first and then reinforced, or reinforced first with stitching or appropriate hardware (not shown) and later cut to form a pass-through opening in sleeve material 4. In the preferred embodiment of the present invention, preliminary reinforcement of transverse opening 8 is favored. The hidden surface of sleeve 2 would also have a first fastener part 12*a* secured to sleeve material 4 near to transverse opening 8, between transverse opening 8 and longitudinal opening 6, and a second fastener part 12*b* secured to sleeve material 4 near to the buckle end 34 of the hidden surface of sleeve 2. Both first fastener part 12*a* and second fastener part 12*b* are centered between the side edges of the hidden surface of sleeve 2. Further, an identically positioned reinforced aperture 10 would be made in both the hidden and exposed surfaces of sleeve 2 near to the end of the strips intended to be the buckle end 34 of sleeve 2. In the hidden surface of sleeve 2, the reinforced aperture 10 would be positioned near to transverse opening 8, between transverse opening 8 and second fastener part 12*b*. The diameter of reinforced apertures 10 should be sufficient in dimension to allow insertion therethrough of the tongue 20 of underlying belt 14, however reinforced apertures 10 should not be unduly large so as to allow a large amount of movement between tongue 20 and sleeve material 4. Although reinforced apertures 10 could be either cut first and then reinforced, in the preferred embodiment reinforced apertures 10 would generally be reinforced first with stitching or appropriate hardware (not shown) and later cut to form a pass-through opening in sleeve material 4. Reinforced apertures 10 near to buckle end 34 could also be joined to one another to bind the exposed and hidden surface of sleeve 2 to each other and to facilitate insertion of tongue 20 through both the hidden and exposed surfaces of sleeve material 4.

Once longitudinal openings 6, transverse opening 8, reinforced apertures 10, first fastener part 12*a,* and second fastener part 12*b* are properly positioned, the right sides of the hidden and exposed surfaces of sleeve 2 would be placed against one another and stitched with durable thread, leaving one small unstitched opening for use in turning sleeve material 4 right-side-out. In the preferred embodiment it is contemplated for the width dimension of the seams connecting the hidden and exposed surfaces of sleeve 2 to range between approximately one-fourth inches and five-eighths inches. The two connected strips would then be turned right-side-out and the raw edges of the small unstitched opening used to reverse sleeve material 4 would be tucked inward and stitched to prevent them from becoming frayed during laundering and use. Optionally, in place of other stitching, or in addition thereto, all four of the edges can be top-stitched to further secure them or provide a color accent. If, instead of comprising separate exposed and hidden surfaces, sleeve 2 is formed from a single strip of sleeve material 4, the sleeve material 4 would first be centrally folded along fold line 26 to properly align longitudinal openings 6 and reinforced apertures 10. Although the folded edge of sleeve material 4 along fold line 26 would not need to be stitched, in the preferred embodiment stitching close to fold line 26 would be used to help the folded edge remain in a flattened non-twisted configuration during use. Optionally, if sleeve material 4 is thick, bulky, or expensive, an anchoring panel 38 made from a thinner or less expensive material could be used to form the buckle end 34 of the exposed surface of sleeve 2. During use the distal end 36 of sleeve 2 would cover anchoring panel 38 to hide it from a casual observer. Reinforced aperture 10 would be positioned through anchoring panel 38, when it is used. Optionally also, second fastener part 12*b* can be either attached to sleeve material 4 by stitching, adhesives, bonding agents, or a combination thereof, or attached directly to the main body 16 of underlying belt 14 by similar attachment means.

To use sleeve 2, a person (not shown) would insert underlying belt 14 into transverse opening 8 on the hidden side of sleeve 2, aligning the hidden side of sleeve 2 with the back surface of belt 14, as shown in FIGS. 3 and 8. In the alternative when sleeve 50 is used, the distal end of belt 14 would be inserted into pocket 52, also while aligning the hidden side of sleeve 2 with the back surface of belt 14. Depending upon the length and width dimensions of belt 14, belt loop 22 and rivet 24 might also become inserted through transverse opening 8. If the front portion of belt loop 22 is to remain visible during use of sleeve 2 or sleeve 50, the buckle end 34 of sleeve 2 or 50 would next be slightly gathered and inserted through belt loop 22 being careful not to fold or twist sleeve material 4, after which buckle end 34 would again be opened substantially flat for easy connection of tongue 20 with reinforced aperture 10. With at least the non-buckle end of belt 14 inserted between the exposed and hidden surfaces of sleeve 2 or 50, and belt loop 22 optionally engaged, tongue 20 is then moved into a position substantially perpendicular to main body 16 and buckle 18, and thereafter inserted through reinforced aperture 10. While holding tongue 20 within reinforced aperture 10, buckle end 34 of sleeve material 4 would then be slightly gathered and forced through the central aperture in buckle 18. Sleeve material 4 is then pulled taut and the buckle end 34 of sleeve material 4 is opened again into a substantially flat configuration. While again securing tongue 20 within reinforced aperture 10, buckle end 34 is folded back upon itself until first fastener part 12*a* becomes positioned directly over second fastener part 12*b*. First fastener part 12*a* and second fastener part 12*b* are then securely joined. When tongue 20 is again moved into a position substantially parallel to sleeve material 4 and buckle 18, sleeve 2 becomes completely assembled over belt 14 with distal end 36 completely covering belt 14, except the front surface of belt loop 22 when it is purposefully left exposed. If sleeve material 4 must be substantially narrowed to allow it to pass through the central opening 48 of buckle 18, several small folds or gathers may develop and remain in the portion of sleeve material 4 adjacent to reinforced aperture 10 during use. To then place belt 14 and sleeve 2 in use, the non-buckle end of belt 14 covered by the distal end of sleeve 2 would then be positioned adjacent to the rear surface of belt buckle 18, and subsequently inserted through the central opening 48 in belt buckle 18, until the belt hole 30 or transverse slot 32 in the non-buckle end of belt 14 needed to close belt 14 and sleeve 2 into their circular usable configurations becomes aligned with tongue 20. Using two hands and opposing fingers and thumbs, the person (not shown) fastening belt 14 would then flatten tongue 20 against belt buckle 18 and press the distal end 36 of sleeve material 4 against the front surface of the adjacent portion of the exposed surface of sleeve 2. If the front surface of belt loop 22 remains outside of sleeve material 4, distal end 36 could then be inserted through and further anchored by belt loop 22. In addition, if the garment (not shown) intended for use with belt 14 and sleeve 2 contains belt alignment loops, such alignment loops could be further used to anchor distal end 36.

To remove belt 14 from within sleeve 2 or 50, one would first pull distal end 36 out of any belt alignment loops (not shown) used, and belt loop 22 if also used. One would then hold buckle 18 with one hand and with the fingers and thumb on the other hand lift distal end 36 into an approximately perpendicular orientation relative to buckle 18. As distal end 36 is lifted, tongue would also become oriented into a position substantially perpendicular to buckle 18, whereby the belt hole 30 used to close belt 14 and sleeve 2 into their usable circular configurations can then be removed and lifted away from tongue 20. Thereafter, distal end 36 would be drawn backwards through buckle 18. When buckle end 34 and distal end 36 of sleeve 2 or 50 thus become separated from one another, sleeve 2 or 50 can be turned over to expose its hidden surface. First fastener part 12*a* would then be separated from second fastener part 12*b* and the buckle end 34 of sleeve 2 or 50 lifted away from the remainder of sleeve material 4 to expose the uppermost rear surface of main body 16. With one hand holding buckle 18, the operator's other hand can be used to pull the buckle end 34 of sleeve material 4 backwards through buckle 18, while at the same time sliding reinforced aperture 10 upward and off of tongue 20. After buckle end 34 has been completely removed from buckle 18 and with one hand holding sleeve 2 or 50 by its distal end, the other hand can use buckle 18 to pull belt 14 from within sleeve material 4. Belt 14 is then available for independent use, or for later insertion into the same or a different sleeve 2 or 50.

What is claimed is:

1. A readily installed and detachable flexible sleeve system for diversifying the functionality of a belt used as a garment accessory and having a buckle with a tongue as well as a minimum of one hole near to a non-buckle end, said sleeve system comprising:

an elongated quantity of material having a buckle end and a distal end, said material also having minimum length and width dimensions sufficient to cover a front surface of a belt intended for use with said system and completely hide the front surface from view, said distal end of said material also being adapted in form to create a pocket of sufficient size for containment of the non-buckle end of the belt;

at least one reinforced aperture formed through said material near to said buckle end, each of said reinforced apertures being adapted for anchoring the tongue of the belt;

a transverse opening formed in said material and having a minimum width dimension slightly larger than the width dimension of the belt contemplated for use with said sleeve system, said transverse opening communicating with said pocket;

at least one opening formed through said distal end of said material, each of said at least one opening being adapted for facilitating alignment of the tongue with one belt hole in the non-buckle end of the belt for closure of the belt; and attachment means adapted for securing a first part and a second part of at least one two-part fastener in place once the non-buckle end of the belt is inserted with said pocket and the tongue extends through the reinforced aperture, whereby the appearance of the belt can be changed and made more versatile as a fashion accessory without interfering with the routine closure and use of the belt.

2. The sleeve system of claim 1 further comprising at least one quickly releasable two-part fastener with a second part attached to said material between said reinforced aperture and said buckle end, and a first part located at a spaced-apart distance from said reinforced aperture in an opposed position relative to said reinforced aperture from said first fastener part, and wherein the first and second parts of the two-part fastener are selected from a group consisting of hook-and-loop fasteners, snaps, hooks and eyes, magnetic fasteners, and broad flat U-shaped skirt hooks each associated with a connecting bar.

3. The sleeve system of claim 1 wherein each of said openings is selected from a group consisting of small round apertures, large round openings, oval openings, square openings, and elongated longitudinal openings.

4. The sleeve system of claim 1 wherein said distal end and said buckle end each have a configuration selected from a group consisting of square end configurations, round end configurations, and tapered end configurations.

5. The sleeve system of claim 1 wherein said material comprises an exposed front member and a hidden back member with an outside surface, wherein said exposed front member and said hidden back member have substantially identical length dimensions, and further wherein each said two-part fastener is connected to said outside surface of said hidden back member.

6. The sleeve system of claim 5 wherein said exposed front member and said hidden back member are formed from a single piece of said material folded longitudinally.

7. The sleeve system of claim 5 wherein said exposed front member and said hidden back member are formed from a single elongated piece of said material and share a laterally extending fold line.

8. The sleeve system of claim 7 further wherein said exposed front member and said hidden back member are substantially equivalent in length.

9. The sleeve system of claim 5 wherein said exposed front member has an inside surface and said system further comprises a lining piece of fabric attached to said inside surface of said exposed front member, said lining piece of fabric having length and width dimensions substantially equivalent to but slightly smaller than said inside surface.

10. The sleeve system of claim 5 further comprising an anchoring panel connected to said exposed front member and at least two of said reinforced apertures, said anchoring panel comprising fabric of different composition from said material, and one of said reinforced apertures extending through said anchoring panel.

11. The sleeve system of claim 1 wherein said first part of said two-part fastener is connected to the belt intended for use with said sleeve system.

12. The sleeve system of claim 5 wherein said hidden back member and a portion of said exposed front member are joined to form a short pocket adapted for insertion of the non-buckle end of a belt, and further wherein the remainder of said exposed front surface has a folded stitched edge.

13. A flexible sleeve system for diversifying the functionality of an underlying garment belt, said sleeve system comprising:

a garment belt having a buckle with a tongue, a non-buckle end, a front surface, at least one hole near to said non-buckle end, a plurality of spaced-apart transverse slots, and a minimum of one of said transverse slots being positioned generally near to said non-buckle end for optimum belt closure during use;

a plurality of elongated pieces of material having a buckle end and a distal end, a portion of said pieces of material also having minimum length and width dimensions sufficient to completely cover said front surface of said belt and designated as exposed front members, and a separate portion of said pieces of material designated as hidden back members;

at least one reinforced aperture formed through each of said exposed front members, each of said reinforced apertures being adapted for insertion therethrough of said tongue;

a plurality of quickly releasable two-part fasteners each having a first part and a second part, at least one of said second parts being attached to each of said exposed front members between said buckle end and said reinforced aperture, and each of said first parts being located at a spaced-apart distance from said reinforced aperture in an opposed position relative to said reinforced aperture from said first fastener part;

each of said exposed front members being connected to one of said hidden back members which defines a sleeve with a pocket of sufficient dimension for containing said non-buckle end of said belt;

a transverse opening formed in each said sleeve so as to communicate with said pocket; each said transverse opening having a minimum length dimension slightly larger than the width dimension of said belt;

at least one opening formed in said distal end of each of said exposed front members and each of said hidden back members, each of said openings being adapted for facilitating alignment of said tongue with one of said transverse slots in said non-buckle end of said belt; and attachment means for securing each of said first parts and said second parts of said two-part fasteners in place so that once the elongated material defining a sleeve is successively secured over said belt after being anchored with said tongue and the pocket, whereby the sleeve rapidly and interchangeably effect the appearance of the belt without interfering with the routine closure and use of the belt.

14. A method for quickly and easily changing the appearance of a belt used as a garment accessory and having a buckle with a tongue, said method comprising the steps of:

providing a quantity of sleeve material, a belt with a buckle having a tongue, a non-buckle end, and a front surface, a quantity of thread adapted for stitching, a cutting tool adapted for cutting through said sleeve material, protective reinforcement means adapted to prevent fray of cut edges, at least one quick-release two-part fastener having a first fastener part and a second fastener part, and fastener attachment means;

using said cutting tool to cut out an elongated hidden back surface with opposed ends and an elongated exposed front surface with opposite ends from said sleeve material, said elongated exposed front surface having length and width dimensions greater than said front surface of said belt;

selecting one of said opposed ends as a distal end and one of said opposite ends as a free end;

using said cutting tool to form at least one opening through said exposed front surface near to said free end, and an identical number of openings are formed through said hidden back surface near to said distal end, said openings in said hidden back surface each being formed in alignment with a different one of said openings through said exposed front surface;

using said reinforcement means to strengthen each said opening in said exposed front surface and said hidden back surface so as to prevent unraveling of said sleeve material close there to during repeated insertion and withdrawal of said tongue from said openings;

selecting one of said opposed ends as a proximal end and one of said opposite ends as an attached end;

using said cutting tool to form a transverse opening in said hidden back surface near to said proximal end;

using said reinforcement means to strengthen said transverse opening in said hidden back surface so as to prevent unraveling of said sleeve material around said transverse opening during repeated insertion and withdrawal of said belt from said transverse opening;

using said cutting tool to form a single aperture through said exposed front surface near to said attached end;

using said reinforcement means to strengthen said single aperture in said exposed front surface so as to prevent unraveling of said sleeve material during repeated insertion and withdrawal of said tongue from said single aperture;

securing each said first fastener part to said hidden back surface near to said transverse opening, between said transverse opening and said distal end;

also securing each said second fastener part to said hidden back surface near to said proximal end;

aligning said free end of said exposed front surface with said distal end of said hidden back surface;

also aligning said attached end of said exposed front surface with said proximal end of said hidden back surface;

stitching said exposed front surface and said hidden back surface to one another to form a pocket;

placing said non-buckle end of said belt through said transverse opening and into said pocket; and inserting said tongue into the one of said reinforced openings in said exposed front surface near to said attached end so that said elongated exposed front surface completely covers said front surface of said belt to give said belt a new appearance.

15. The method of claim 14 wherein said reinforcement means for said openings is selected from a group consisting of stitching, grommets, and eyelets.

16. The method of claim 14 wherein said exposed front surfaces and said hidden back surfaces each comprise a perimeter and further comprising the step of using said quantity of thread to apply top-stitching to said perimeters.

17. The method of claim 14 further comprising the step of using said cutting tool to form a single aperture through said hidden back surface near to said proximal end, and wherein said step of reinforcing said single apertures in said hidden back surface and said exposed front surface comprises the connection of said single apertures in said hidden back surface and said exposed front surface to one another.

18. The method of claim 14 wherein said fastener attachment means is selected from a group consisting of stitching, adhesives, and bonding agents.

19. The method of claim 14 further comprising the steps of providing an anchoring panel of fabric distinct from that of said sleeve material, attaching said anchoring panel to said exposed front surface, forming a single aperture through said anchoring panel, and reinforcing said single aperture to prevent unraveling of said anchoring panel fabric.

20. The method of claim 14 wherein said step of using said cutting tools to cut out an elongated hidden back surface with opposed ends and an elongated exposed front surface with opposite ends from said sleeve material is selected from a group consisting of the step of cutting an exposed front surface and a hidden back surface that are separate from one another, the step of cutting an exposed front surface and a hidden back surface that have a common longitudinal edge, the step of cutting an exposed front surface and a hidden back surface that have a common laterally extending edge, the step of cutting an exposed front surface and a hidden back surface that are substantially identical in length, and the step of cutting an exposed front surface and a hidden back surface wherein said hidden back surface is shorter than said exposed front surface.

* * * * *